US008606166B2

(12) United States Patent
Maeda

(10) Patent No.: US 8,606,166 B2
(45) Date of Patent: Dec. 10, 2013

(54) FIXING DEVICE AND IMAGE FORMING APPARTUS

(75) Inventor: Tomohiro Maeda, Oasaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 293 days.

(21) Appl. No.: 13/212,593

(22) Filed: Aug. 18, 2011

(65) Prior Publication Data

US 2012/0045239 A1 Feb. 23, 2012

(30) Foreign Application Priority Data

Aug. 19, 2010 (JP) ..... 2010-183627

(51) Int. Cl.
*G03G 15/20* (2006.01)

(52) U.S. Cl.
USPC ..... 399/337; 399/67

(58) Field of Classification Search
USPC ..... 399/337
See application file for complete search history.

(56) References Cited

U.S. PATENT DOCUMENTS

| | | | | |
|---|---|---|---|---|
| 7,065,309 | B2 * | 6/2006 | Sato | 399/69 |
| 7,430,395 | B2 * | 9/2008 | Iwaishi et al. | 399/336 |
| 8,249,493 | B2 * | 8/2012 | Matsubara et al. | 399/336 |
| 8,406,669 | B2 * | 3/2013 | Egusa et al. | 399/335 |

FOREIGN PATENT DOCUMENTS

| | | | | |
|---|---|---|---|---|
| JP | 06348170 | A * | 12/1994 | G03G 15/20 |
| JP | 07-271238 | A | 10/1995 | |
| JP | 10-143001 | A | 5/1998 | |
| JP | 3016685 | B2 | 3/2000 | |

* cited by examiner

*Primary Examiner* — Clayton E Laballe
*Assistant Examiner* — Leon W Rhodes, Jr.
(74) *Attorney, Agent, or Firm* — Birch, Stewart, Kolasch & Birch, LLP

(57) ABSTRACT

A fixing device includes a laser light source for irradiating an unfixed toner image formed on a recording sheet, and melts a toner by light from the laser light source to fix the toner image on the recording sheet. Here, where a conveyance speed of the recording sheet is p, a length of a light irradiation area in a conveyance direction of the recording sheet is q, time during which the toner of the unfixed image is subjected to light during conveyance is r, and energy per unit area given to the toner of the unfixed image is J, light output of the laser light source is controlled so that the energy during a constant time r1 from the start of a time r is differentiated from the energy during a time r2 until the end of the time r after the elapse of the r1.

8 Claims, 8 Drawing Sheets

FIG. 5

| PROCESS SPEED (mm/s) | TONER SURFACE TEMPERATURE (°C) | FIXABILITY | IRRADIATION TIME (msec) |
|---|---|---|---|
| 300 | 100 | C | 5 |
| 250 | 111 | C | 6 |
| 214 | 134 | C | 7 |
| 188 | 151 | A | 8 |
| 167 | 161 | A | 9 |
| 150 | 182 | A | 10 |
| 136 | 198 | A | 11 |
| 125 | 206 | A | 12 |
| 115 | 225 | A | 13 |
| 107 | 239 | A | 14 |
| 100 | 250 | B | 15 |
| 94 | 263 | B | 16 |

FIG. 6

| PROCESS SPEED (mm/s) | TONER SURFACE TEMPERATURE (°C) | FIXABILITY | IRRADIATION TIME (msec) |
|---|---|---|---|
| 300 | 110 | C | 5 |
| 250 | 122 | C | 6 |
| 214 | 147 | C | 7 |
| 188 | 167 | C | 8 |
| 167 | 178 | C | 9 |
| 150 | 200 | C | 10 |
| 136 | 217 | C | 11 |
| 125 | 227 | C | 12 |
| 115 | 250 | B | 13 |
| 107 | 263 | B | 14 |
| 100 | 275 | B | 15 |
| 94 | 290 | B | 16 |

FIG. 7

| PROCESS SPEED (mm/s) | TONER SURFACE TEMPERATURE (°C) | FIXABILITY | IRRADIATION TIME (msec) |
|---|---|---|---|
| 300 | 110 | C | 5 |
| 250 | 122 | C | 6 |
| 214 | 147 | C | 7 |
| 188 | 167 | C | 8 |
| 167 | 178 | C | 9 |
| 150 | 200 | C | 10 |
| 136 | 200 | C | 11 |
| 125 | 200 | C | 12 |
| 115 | 200 | A | 13 |
| 107 | 200 | A | 14 |
| 100 | 200 | A | 15 |
| 94 | 200 | A | 16 |

FIG. 8

| PROCESS SPEED (mm/s) | TONER SURFACE TEMPERATURE (°C) | FIXABILITY | IRRADIATION TIME (msec) |
|---|---|---|---|
| 300 | 100 | C | 5 |
| 250 | 111 | C | 6 |
| 214 | 134 | C | 7 |
| 188 | 151 | A | 8 |
| 167 | 161 | A | 9 |
| 150 | 182 | A | 10 |
| 136 | 198 | A | 11 |
| 125 | 200 | A | 12 |
| 115 | 200 | A | 13 |
| 107 | 200 | A | 14 |
| 100 | 200 | A | 15 |
| 94 | 200 | A | 16 |

FIXING DEVICE AND IMAGE FORMING APPARTUS

CROSS-NOTING PARAGRAPH

This non-provisional application claims priority under 35 U.S.C. §119(a) on Patent Application No. 2010-183627 filed in JAPAN on Aug. 19, 2010, the entire contents of which are hereby incorporated herein by reference.

FIELD OF THE INVENTION

The present invention relates to an image forming apparatus by means of an electrophotographic method such as a copier, a printer, a facsimile and the like, and more particularly to a fixing device for fixing an image by irradiating an unfixed toner image formed on a recording sheet with light, and an image forming apparatus provided with the fixing device.

BACKGROUND OF THE INVENTION

An image forming apparatus by means of an electrophotographic method (for example, printer) is provided with a fixing device for heating and melting an unfixed toner image formed on a recording sheet so as to be fixed on the recording sheet. As an example of such a fixing device, an image forming apparatus by means of an electrophotographic method is known for irradiating a toner image with light to heat a toner so as to fix the toner image on a recording sheet without any contact. Such a fixing method is, since a toner is heated without any contact, characterized in that a warm-up is not necessary as compared to a roller fixing method which is a conventional contact heating method.

As such an image forming apparatus for fixing images without any contact by light, for example, Japanese Patent Publication No. 3016685 discloses a fixing device for fixing a toner with use of laser power.

The laser fixing device described in the Japanese Patent Publication No. 3016685 is provided with a plurality of semiconductor lasers and a lens array corresponding to the semiconductor lasers, so that a laser beam emitted from the semiconductor laser is condensed on a recording sheet by the lens array to fix an unfixed toner. This is considered to make it possible to realize a small-sized, inexpensive semiconductor laser fixing device.

The fixing device described in Japanese Patent Publication No. 3016685 controls laser strength by temperature detection means, however, since a toner is heated by a laser in a moment, when a temperature of the toner is detected, heating the toner by the laser has already been finished. Accordingly, it is impossible to control heating in real time while the toner itself is heated. In other words, even if light intensity is controlled by detecting a temperature after the toner is heated in a moment, correct feedback is not able to be performed so that it is impossible to perform appropriate control. That is, a light fixing method is not generally able to perform feedback control of light intensity based on a detection result of a toner temperature.

SUMMARY OF THE INVENTION

An object of the present invention is to provide a fixing device that is able to secure favorable fixability by appropriately controlling light output during heating of a toner when an unfixed toner is irradiated with light to be heated and melted, and an image forming apparatus provided with the fixing device.

An object of the present invention is to provide a fixing device including a conveyance portion for conveying a recording medium; a light source for irradiating an unfixed toner image formed on the recording medium conveyed by the conveyance portion; and a light output control portion for controlling light output from the light source, that melts a toner of the toner image by light from the light source to fix the toner image to the recording medium, wherein, when a conveyance speed of the recording medium is p (mm/sec), a length of a light irradiation area on the recording medium in a conveyance direction of the recording medium is q (mm), time during which the toner of the unfixed image is exposed to light while it is conveyed is r (sec) (r=q/p), and energy that is given to the toner of the unfixed image per unit area is J (J=light output per unit area (W/mm$^2$)×time r (sec)), the light output control portion controls the light output of the light source so that the energy during constant time r1 (sec) from the start of the time r is differentiated from the energy during time r2 (sec) until the end of the time r after the elapse of the r1 (r2=r−r1).

Another object of the present invention is to provide a fixing device wherein the light output control portion that controls the light output of the light source by a current value and light-emission duty, causes the light source to continuously emit light with 100% light-emission duty at a constant current value during the time r1, and causes the light source to intermittently emit light by making the light-emission duty less than 100% at the same current value as that in the r1 during the time r2.

Another object of the present invention is to provide a fixing device, in which the light output control portion makes a current value of the light source during the time r1 is to be C, and a current value of the light source during the time r2 is to be D (C>D), and causes continuous light emission with 100% light-emission duty during both the time r1 and the time r2.

Another object of the present invention is to provide a fixing device including a semiconductor laser as the light source.

Another object of the present invention is to provide a fixing device, in which the light source has a plurality of the semiconductor lasers, and the plurality of the semiconductor lasers form a laser array arranged in an array in a direction orthogonal to a conveyance direction of a recording sheet.

Another object of the present invention is to provide an image forming apparatus provided with the above-described fixing device.

BRIEF DESCRIPTION OF THE DRAWINGS

FIG. 5 is a diagram showing an evaluation result of a surface temperature and fixability of a toner by laser beam irradiation;

FIG. 6 is a diagram showing an evaluation result of a surface temperature and fixability of a toner by laser beam irradiation;

FIG. 7 is a diagram showing an evaluation result of a surface temperature and fixability of a toner by laser beam irradiation; and FIG. 8 is a diagram showing an evaluation result of a surface temperature and fixability of a toner by laser beam irradiation.

PREFERRED EMBODIMENTS OF THE INVENTION

Figure 1:
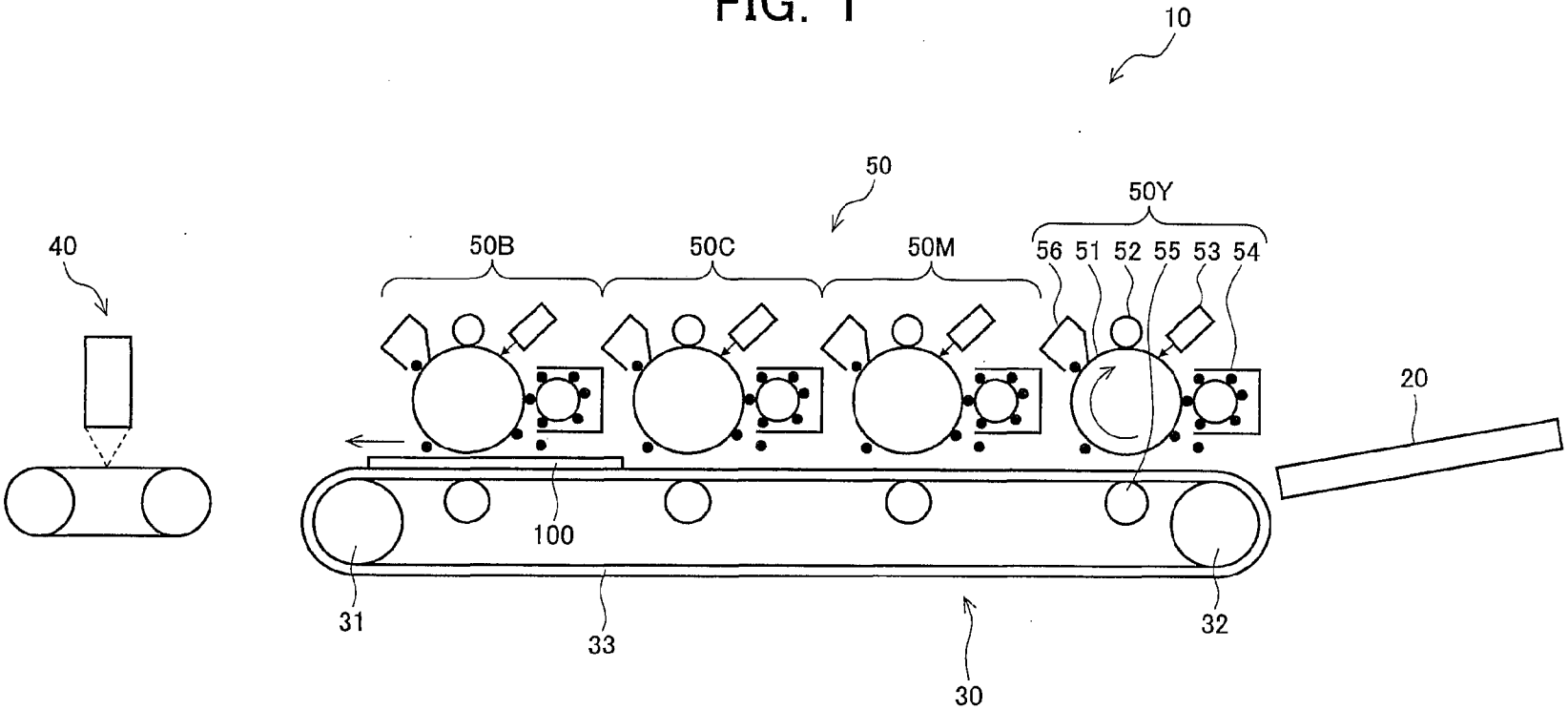
FIG. 1 is a diagram showing an internal structure of a color image forming apparatus by means of a dry electrophotographic method applicable to the present invention.

Hereinafter, preferred embodiments of the present invention will be described in detail with reference to the accompanying drawings. Note that, in the specification and drawings herein, the components having substantially the same functions and configurations are allotted with the same reference numerals so that repeated description is omitted.

FIG. 1 is a diagram showing an internal structure of a color image forming apparatus by means of a dry electrophotographic method applicable to the present invention. An image forming apparatus 10 is provided with a supply tray 20, a conveying device 30, a fixing device 40 and visible image formation units 50 (50Y, 50M, 50C, 50B), and for example, forms a multicolor image or a unicolor image on a predetermined recording medium based on image data sent from each terminal device over a network, and the like. As a recording medium, a recording sheet, a film for recording or the like is usable. Hereinafter, description will be given by assuming that a recording sheet is used.

The image forming apparatus 10 is provided with four visible image formation units 50Y, 50M, 50C and 50B that are arranged in parallel to each other, corresponding to each color of yellow (Y), magenta (M), cyan (C) and black (B). The visible image formation unit 50Y performs image formation with use of a toner of yellow (Y), the visible image formation unit 50M performs image formation with use of a toner of magenta (M), the visible image formation unit 50C performs image formation with use of a toner of cyan (C), and the visible image formation unit 50B performs image formation with use of a toner of black (B). Specific arrangement includes so-called tandem arrangement in which four sets of visible image formation units 50 are arranged along a conveyance path of a recording sheet 100 for connecting the supply tray 20 and the fixing device 40.

Each of the visible image formation units 50 substantially has the same configuration, and is provided with a photoreceptor drum 51, a charger 52, a laser beam irradiation portion 53, a developing equipment 54, a transfer roller 55 and a drum cleaner unit 56 for performing multi layer transfer with each color of the toners to the recording sheet 100 to be conveyed. The laser beam irradiation portion 53 is provided with a semiconductor laser as a light source.

The photoreceptor drum 51 carries a toner image that is transferred to a recording sheet. Further, the charger 52 uniformly charges the surface of the photoreceptor drum 51 to a predetermined potential.

The laser beam irradiation portion 53 exposes the surface of the photoreceptor drum 51 charged by the charger 52 corresponding to image data input by the image forming apparatus 10, and forms an electrostatic latent image on the surface of the photoreceptor drum 51. Additionally, the developing equipment 54 visualizes the electrostatic latent image formed on the surface of the photoreceptor drum 51 using color toners. The transfer roller 55 has bias voltage with polarity opposite to that of the toner applied thereto, and transfers a toner image to the recording sheet 100 conveyed by the conveying device 30 for a recording sheet. The drum cleaner unit 56 removes and collects a toner remained on the surface of the photoreceptor drum 51 after transfer of an image formed on the photoreceptor drum 51. Transfer of a toner image to the recording sheet 100 as described above is repeated four times for four colors.

The conveying device 30 is comprised of a driving roller 31, an idling roller 32 and a conveyor belt 33, and conveys the recording sheet 100 so that a toner image is formed on the recording sheet 100 by the visible image formation units 50. The driving roller 31 and the idling roller 32 are provided for stretching out the endless conveyor belt 33, and the driving roller 31 rotates at a predetermined circumferential speed under control so as to rotate the endless conveyor belt 33. The conveyor belt 33 generates static electricity on an outer surface thereof, and conveys the recording sheet 100 by means of electrostatic adsorption.

Figure 2:
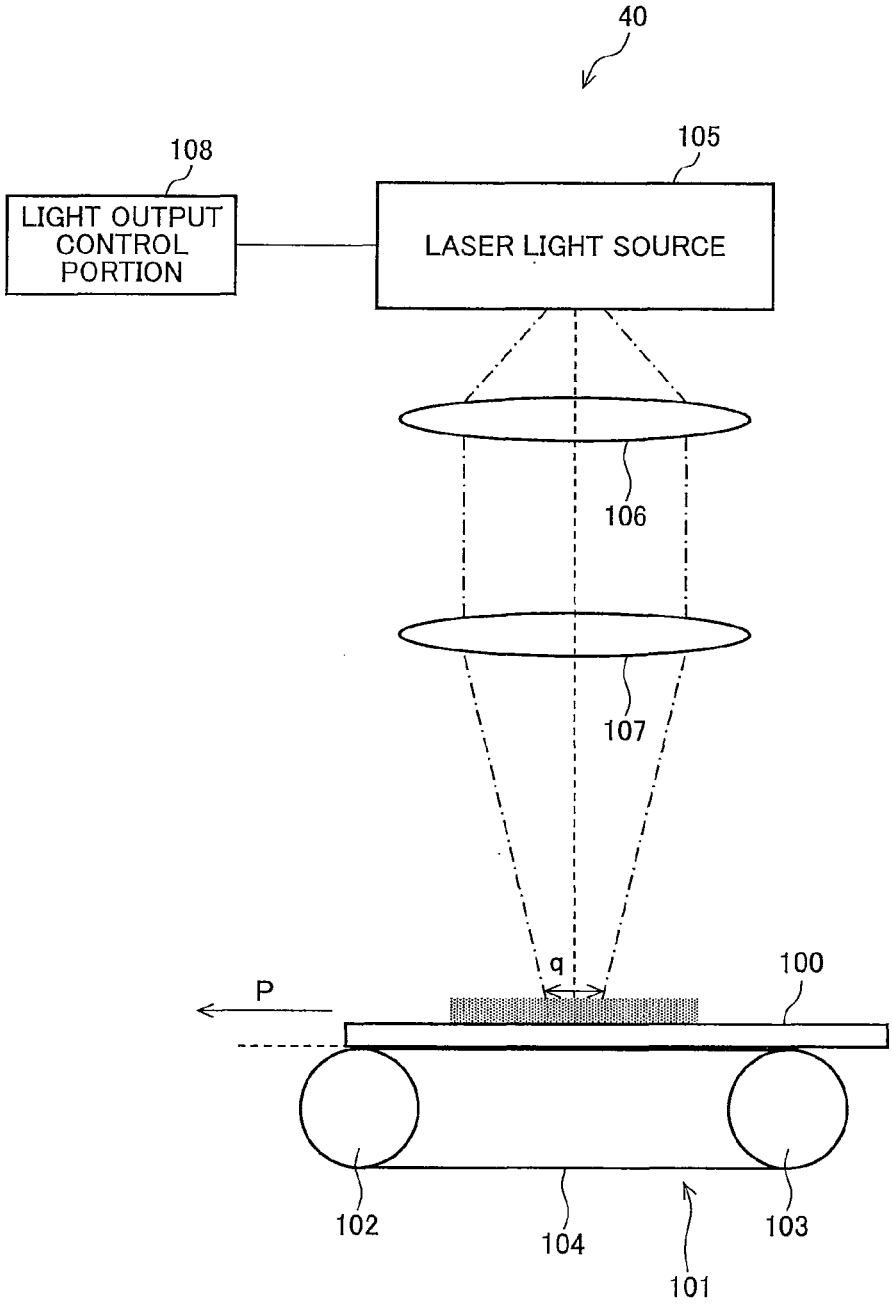
FIG. 2 is a diagram schematically showing a configuration of a fixing device according to the present invention.

The recording sheet 100 is fallen away from the conveyor belt 33 due to the curvature of the driving roller 31 and conveyed to the fixing device 40 after a toner image is transferred on the recording sheet 100 during the recording sheet 100 is conveyed by the conveyor belt 33. The fixing device 40 applies appropriate heat to the recording sheet 100 for dissolving a toner to be fixed to the recording sheet so as to form a stout image. Here, the above-described fixing device is described in detail using FIG. 2. FIG. 2 is a diagram schematically showing a configuration of the fixing device according to the present invention.

The fixing device 40 is provided with a laser light source 105, a recording sheet conveying device 101 for conveying the recording sheet 100 and alight output control portion 108 for controlling light output of the laser light source 105.

Means for irradiating an unfixed toner of a recording sheet with light typically includes a flash lamp, LED and the like, however, the laser light source 105 is used in an embodiment according to the present invention. Since a laser has less light diffusion and therefore is able to effectively condense light by being used in combination with a condensing lens, it is able to lead to the greatest light output per unit area ($W/mm^2$) at an irradiated part. Additionally, using a semiconductor laser makes it possible to reduce the cost. Further, depending on compounding and material composition of a semiconductor device, it is possible to generate a laser beam with any wavelength in the range of 400 nm to 1000 nm.

In the present embodiment, the semiconductor laser whose emission wavelength is 808 nm is used. The laser light source 105 is a semiconductor laser array in which a plurality of semiconductor laser devices are arranged in an array in a direction orthogonal to a conveyance direction of the recording sheet 100, and 300 semiconductor laser devices with maximum output of 2 W are arranged, and an arrangement pitch of each laser device is 1 mm.

The laser light source 105 is connected to the light output control portion 108 to apply constant voltage of 2 V to one semiconductor laser device, and a current value is controllable up to 2 A at a maximum (light output is 2 W at that time), so that it is possible to obtain any light output (electric power) in a range of maximum output or less. Further, as another electric power control method, an ON-OFF signal (pulse signal) of light output is input to a laser driver side, and duty is variably set so as to be able to control light output. At this time, electric power is controlled at a constant current value according to ON-OFF of the pulse signal.

Light output from the laser light source 105 serves as parallel light to a conveyance direction of the recording sheet 100 with a collimated lens 106. A condensing lens 107 then condenses light so as to focus only light in a paper conveyance direction at a focus position. A distance in a light axis direction between the focus position and the condensing lens is regarded as a focus distance f. In the present embodiment, the focus distance f=48 mm.

Here, light in a direction vertical to the conveyance direction of the recording sheet 100 is not condensed in particular, however, may be condensed in any areas separately using a lens. For example, in the case of desiring for condensing light in about 300 mm width corresponding to the width of an A4 recording sheet, it is possible to set a light irradiation area to the area of 300 mm width.

Further, a plurality of laser light sources 105 are arranged in a direction vertical to the conveyance direction of the recording sheet 100 (width direction of a recording sheet conveyor belt 104). For example, when light irradiation is attempted to be performed over an entire surface of the recording sheet using one semiconductor laser device, it is necessary to scan the recording sheet with a laser beam in a direction vertical to a conveyance direction of a recording sheet other than the conveyance direction of the recording sheet 100 and it takes time for a fixing process, thus there is a case where a fixation defect is generated in the case of a fast fixing speed of a high-speed machinery and the like. Moreover, a configuration in which a laser beam is used to scan a recording sheet makes a fixing device complicated and leads to cost rises.

Whereas, in an embodiment according to the present invention, the laser light source 105 is configured by arranging a plurality of semiconductor laser devices in an array in a direction vertical to the conveyance direction of the recording sheet 100 (width direction of the recording sheet conveyor belt 104). This makes it possible not to scan the recording sheet 100 with a laser beam in a direction vertical to the conveyance direction of the recording sheet 100, to configure a fixing device to have minimum space, and to fix a toner at a further high speed.

The recording sheet conveying device 101 is provided with two tension rollers 102 and 103, and the heat-resistant recording sheet conveyor belt 104. The recording sheet 100 is conveyed on the recording sheet conveyor belt 104. The two tension rollers 102 and 103 have shaft centers not-shown connected to bearings not-shown, and the tension roller 102 is connected to a driving portion not-shown via a gear not-shown.

The recording sheet conveyor belt 104 is comprised of materials in which a conductive member such as carbon is dispersed in a resin such as polycarbonate, vinylidene fluoride, polyamide-imide, or polymide. Further, it is configured such that voltage is applied by bias applying means not-shown that is connected to the inner surface of the recording sheet conveyor belt 104 so that the recording sheet 100 is electrostatically adsorbed to the surface (outer circumferential surface) of the recording sheet conveyor belt 104. The recording sheet 100 is electrostatically adsorbed to the recording sheet conveyor belt 104 so that the recording sheet conveyor belt 104 adheres tightly to the recording sheet 100 and it is possible to prevent the recording sheet from floating up as much as possible. The surface of the recording sheet conveyor belt 104 intersects with a surface vertical to a light axis as shown in FIG. 2.

An unfixed toner image is formed by a toner contained in developer such as nonmagnetic one-component developer containing a nonmagnetic toner, nonmagnetic two-component developer containing a nonmagnetic toner and carrier, magnetic developer containing a magnetic toner, or the like.

Further, since a color toner (yellow, magenta, cyan) has lower absorptance of a laser beam compared to a monochrome toner, absorptance approximately the same as that of a monochrome toner is secured by adding an infrared absorption agent (for example, cyanine compound). For example, since a wavelength of a laser beam is about 780 nm in the case of a semiconductor laser, a monochrome toner has higher absorptance of a laser beam (about 60%), but a color toner has lower absorptance (about 10%), a fixation defect occurs in the case of a color image. Therefore, an infrared absorption agent is added to a color toner so that it is possible to realize absorptance approximately the same as that of a monochrome toner and overcome the fixation defect.

Next, a control example of light output that characterizes the present invention will be described.

In a fixing device for fixing a toner by light energy, energy per unit area ($J/mm^2$) given to an unfixed toner that is conveyed is obtained from the product of light output per unit area ($W/mm^2$) and light irradiation time (s) applied to a toner in a light irradiation range.

Accordingly, in a case where light with the same energy (light output per unit area×light irradiation time) is applied to a toner to be fixed, by condensing light with a lens to make light output per unit area (watt density) greater for performing irradiation in a short light irradiation time, more heat losses to a recording sheet and into the atmosphere are cut, and it is possible to effectively heat (that is, fix at a less energy amount) only a toner.

For performing high light output (high watt density), there is a need to condense light with a lens, or make output on a light source side greater as much as possible. In the case of constant light condensing, heating a toner instantly by maximizing output of a light source is the most effective since heating is able to be performed with less energy. However, in the case of heating with light, the surface of a toner absorbs light to be melted instantly, however, when light does not reach the vicinity of an interface between a toner and a recording sheet (underlying toner), for example, in the case of forming a toner layer in which three colors are layered or the like, the underlying toner in the vicinity of the interface comes to be heated by heat transferred from the surface.

In such a case, since the toner on the surface comes to have a high temperature and the toner in the vicinity of the interface is not sufficiently heated, even though the toner on the surface has a temperature increased to the extent that thermal decomposition occurs, the toner in the vicinity of the interface has a low temperature and is insufficiently melted, resulting in a state where fixability is not able to be secured.

Figure 3:
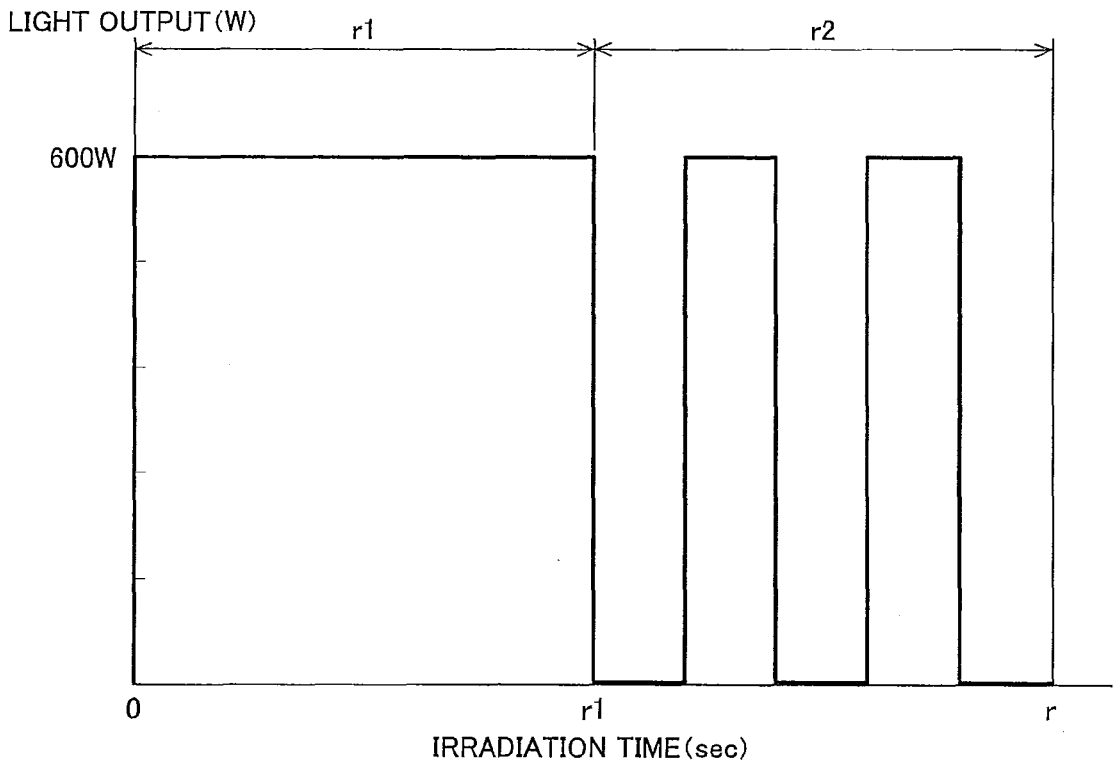
FIG. 3 is a diagram showing a control example of light output of the fixing device according to the present invention.

For addressing such a problem, in an embodiment according to the present invention, control of light output is performed as shown in FIG. 3. In this example, where time during which a toner is subjected to light from the laser light source 105 (irradiation time) is r (sec), a laser beam is irradiated to the toner by keeping high output constant until constant time r1 (sec) elapses from the start of the time r. Here, the laser light source 105 is continuously output at a constant current. Therefore, light output duty becomes 100%.

Then, during the time r2 (sec) until the end of the time r after the elapse of the time r1, light output duty is controlled at a value less than 100% to perform intermittent light emission. In a case where duty control is performed, a trigger signal is generated by a pulse generator while controlling a current value for driving the laser light source 105 so as to be kept constant, and ON-OFF timing of a laser drive unit is controlled by the trigger signal so that it is possible to variably set duty of laser emission. In an example of FIG. 3, light output duty is set to 50%. This makes it possible to differentiate energy given to a toner between the time r1 and the time r2, and to make energy during the time r2 smaller than energy during the time r1, so that it is possible to suppress temperature rising of the toner. Further, a simple driving circuit makes it possible to control light output of the laser light source 105, and to arbitrarily set energy given to a toner.

Figure 4:
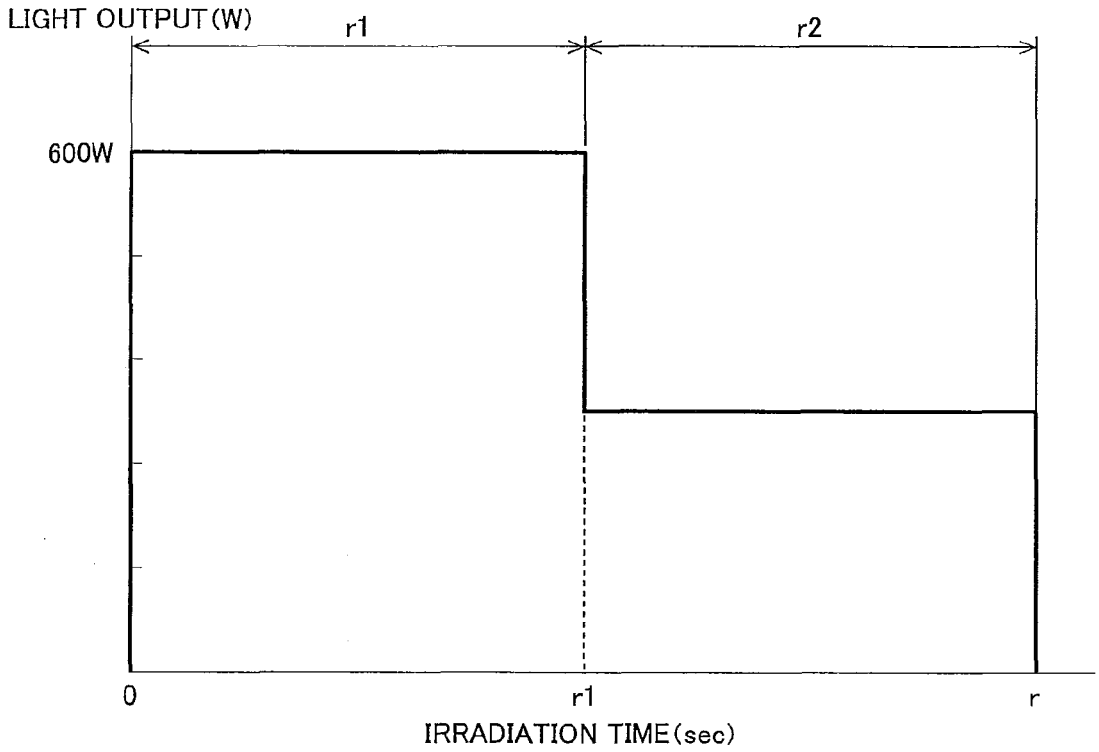
FIG. 4 is a diagram showing another control example of light output of the fixing device according to the present invention.

FIG. 4 is a diagram showing another control example of light output. In the above-described example of FIG. 3, the current value for driving the laser light source 105 is kept constant to control light-emission duty so that energy given to a toner is optimized. Whereas, in the present control example, during the time r1 (sec), the laser light source 105 is driven at a current value I1 to continuously irradiate light of high output. Therefore, light output duty becomes 100%. Then during the time r2 after the elapse of the time r1, a current value I2 is set so that I2=1/n×I1 (n>0), and light of low output is continuously irradiated. Therefore, I1>I2. Also in this case, light output duty becomes 100%.

In this manner, it is possible to differentiate a current value for driving the laser light source 105 between the time r1 and the time r2 for energy given to a toner, and to make energy during the time r2 smaller than energy during the time r1, so that it is possible to suppress temperature rising of the toner. Further, a simple driving circuit makes it possible to control output of the laser light source 105, and to arbitrarily set energy given to a toner.

Under control as described above, since a toner is heated by high energy and thereafter heating by low energy is able to be performed so as not to overheat the toner, it is possible to obtain favorable fixability. Further, light irradiation time to a toner is decided depending on a conveyance speed (process speed) and a length in a conveyance direction of an irradiation area of a recording sheet, and even in a case where the recording sheet slips during conveyance due to some troubles and the irradiation time is thereby extended, it is possible to prevent excessive rising of a surface temperature of the toner by performing the above-described control.

Based on the above-described control method, experiments for evaluating heating and fixing of a toner were performed. The results are described below.

(Experiment 1)

A recording sheet on which an unfixed image with one color (for example, cyan) was formed was prepared, and evaluation was performed concerning relation between a surface temperature and fixability of a toner at the time of reaching the highest temperature in an irradiation area of a laser beam by arbitrarily varying a conveyance speed (process speed) of the recording sheet. At the time, an adhesion amount of the toner for forming the unfixed image was 0.4 mg/cm$^2$. In this case, as the process speed was changed, the irradiation time of a laser beam was changed. Additionally, in an evaluation experiment, the surface of a toner is shot by a high-speed camera, and a melting process of the toner was observed.

A length of a light irradiation area in a conveyance direction of the recording sheet was 1.5 mm and width of the light irradiation area in a direction vertical to the conveyance direction of the recording sheet was 300 mm as an irradiation condition of a laser beam, and an irradiation area of the above range was irradiated with a laser beam at output of 600 W. Then, a surface temperature of the toner that was subjected to the laser beam in the above-described irradiation area was measured with a radiation thermometer. Results at the time are shown in FIG. 5. In evaluation of fixability, A indicates that fixability is favorable, C indicates that fixability is insufficient, and B indicates that fixability is secured but the toner is subjected to thermal decomposition. Hereinafter, much the same is true on other experimental results.

As shown in FIG. 5, in a case where a process speed was 214 mm/sec or more, a toner was not sufficiently melted and a fixation defect in which the toner fell out of a recording sheet was found, however, fixability was able to be secured at 188 mm/sec or less of the process speed. On the other hand, in a case where the process speed was 100 mm/sec or less, a surface temperature of the toner was increased to around 250 degrees centigrade. As a result of observation with the high-speed camera, a phenomenon that the toner was thermally decomposed and gas is produced was found under this condition. Accordingly, thermal decompose a toxic gas was produced due to thermal decomposition of the toner in some cases when a surface temperature of a toner reaches 250 degrees centigrade or more, and it was found that the above condition was not usable in consideration of an environmental problem and the like.

In other words, a heating temperature of a toner for obtaining a favorable fixed image is in a range of 150 degrees centigrade to 250 degrees centigrade. However, in the case of the condition of this experiment, since there is only a small margin between a heating time required for fixing the toner (8 msec or more here) and a time during which the toner is thermally decomposed due to excessive heating (15 msec or more here), there is a possibility that the temperature of the toner reaches a thermal decomposition temperature due to a slight change of the irradiation time.

(Experiment 2)

The same evaluation as the experiment 1 was performed using a recording sheet on which an unfixed image was formed by stacking three color toners of C, M and Y one on top of the other. At this time, an adhesion amount of the toner for forming a fixed image was set to 1.2 mg/cm$^2$ for three colors. This result is shown in FIG. 6.

As shown in FIG. 6, when three color toners were stacked in layers, it was possible to secure fixability in a case where a process speed was 115 mm/sec or less. However, in the case of 115 mm/sec or less of the process speed, a surface temperature of the toner reached 250 degrees centigrade or more and thermal decomposition of the toner was started. Accordingly, there were no conditions where favorable fixability was able to be secured without thermal decomposition of the toner. This may be considered that because of too much increase of the surface temperature of the toner, thermal decomposition of the surface of the toner started before or at the same time that the toner on an interface of a recording sheet is sufficiently melted.

(Experiment 3)

Similarly to the above-described experiment 2, a recording sheet on which an unfixed image was formed by stacking three color toners of C, M and Y one on top of the other (adhesion amount of the toner was 1.2 mg/cm$^2$ for three colors) was used, and at the process speed (115 mm/sec or less) which fixability was able to be secured but thermal decomposition occurred in the experiment 2, a state of light output (W) was controlled by electric power control of a light source.

Specifically, duty control as shown in FIG. 3 was performed to temporally change light energy. Here, at first, a process speed was set to 115 mm/sec, and the irradiation time r was set to 13 msec. Then, light was continuously output up to r1=10 msec. Therefore, light output duty during the r1 became 100%. Thereafter, during r2=3 msec, light output was performed with 50% light output duty.

Next, the process speed was set to 107 mm/sec, r=14 msec, and light was continuously output up to r1=10 msec, thereafter light was output for r2=4 msec at a frequency of 10 kHz with 50% duty.

Similarly, the process speed was set to 100 mm/sec, r=15 msec, and light was continuously output up to r1=10 msec, thereafter light was output for r2=5 msec with 50% duty.

Similarly, the process speed was set to 94 mm/sec, r=16 msec, and light was continuously output up to r1=10 msec, thereafter light was output for r2=6 msec with 50% duty. Relation between the surface temperature and fixability of the toner at the time is shown in FIG. 7.

As shown in FIG. 7, continuous irradiation of light during the time r1 in the early irradiation is combined with duty control during the time r2 thereafter, thereby performing maximum light irradiation during the time r1, so that it is possible to raise a surface temperature of a toner immediately up to 200 degrees centigrade, thereafter suppressing the surface temperature of the toner to 200 degrees centigrade. This makes it possible to heat a toner effectively and obtain a condition that a temperature of a toner does not reach a thermal decomposition temperature while securing fixability.

(Experiment 4)

Similarly, for an unfixed image of one color whose adhesion amount of a toner is 0.4 mg/cm$^2$, fixing processing was performed for evaluation by continuous irradiation of light in the early irradiation in combination with duty control thereafter. Results at the time are shown in FIG. 8.

In the experiment 1, a margin of a heating time that a toner is able to be fixed without thermal decomposition was 8 msec to 14 msec, while a surface temperature of a toner is controlled in this experiment and a further extended margin of the heating time was thus able to be obtained (8 to 16 msec or more).

This makes it possible to prevent excess increase of a surface temperature of a toner, for example, even when paper slips due to some troubles and the irradiation time is thereby extended while a recording sheet is conveyed.

(Experiment 5)

Similarly to the above-described experiments 1 to 4, the same effect was obtained even though light output was controlled in such a manner as shown in FIG. 4. Specifically, light was continuously output at 600 W during the time r1 of FIG. 4, and thereafter during the time r2, light was continuously output at 300 W by reducing a peak current. In such a case, light was continuously output with 100% duty for both cases.

Also for such an experiment, the result similar to those of the experiments 1 to 4 was obtained, and it was possible to obtain favorable fixation properties also by current-controlled energy control.

From the results as described above, where a conveyance speed of a recording sheet is p (mm/sec), light irradiation width on the recording sheet in a conveyance direction of the recording sheet is q (mm), time during which a toner of an unfixed image is subjected to light during conveyance is r (sec) (r=q/p), and energy per unit area given to the toner of the unfixed image is J (J=light output per unit area (W/mm$^2$)× time r (sec)), light output of a light source is controlled so that energy during the time r2 (sec) until the end of the time r after the elapse of the r1 (r2=r−r1) becomes smaller than energy during the constant time r1 (sec) from the start of the time r, and it is thereby possible to heat and melt a toner effectively.

Although the time r1 and the time r2 were set to control so that a surface temperature of a toner did not reach 200 degrees centigrade or more in the experiments 3 and 4, values of r1, r2, light output, frequencies, duty and the like may be set corresponding to a process speed and light irradiation width r so that the present invention is not limited to such conditions to be able to appropriately control the surface temperature of the toner corresponding to melting properties, heat resistance and the like.

Further, although electric power control was separately performed during two periods of the time r1 and the time r2 in the experiments, the irradiation time r may be divided into n periods so that r=r1+r2+ . . . +rn, for performing individual electric power control for each of n periods.

As described above, according to the present invention, it is possible to provide a fixing device in which light output is appropriately controlled during heating of a toner when light is irradiated to an unfixed toner to be heated and melted so that favorable fixability is able to be secured, and an image forming apparatus provided with the fixing device.

The invention claimed is:

1. A fixing device comprising a conveyance portion for conveying a recording medium; a light source for irradiating an unfixed toner image formed on the recording medium conveyed by the conveyance portion; and a light output control portion for controlling light output from the light source, that melts a toner of the toner image by light from the light source to fix the toner image to the recording medium, wherein when a conveyance speed of the recording medium is p (mm/sec), a length of a light irradiation area on the recording medium in a conveyance direction of the recording medium is q (mm), time during which the toner of the unfixed image is exposed to light while it is conveyed is r (sec) (r=q/p), and energy that is given to the toner of the unfixed image per unit area is J (J=light output per unit area (W/mm$^2$)×time r (sec)), the light output control portion controls the light output of the light source so that the energy during a constant time r1 (sec) from the start of the time r is differentiated from the energy during time r2 (sec) until the end of the time r after the elapse of the r1 (r2=r−r1), wherein the light output control portion that controls the light output of the light source by a current value and light-emission duty, causes the light source to continuously emit light with 100% light-emission duty at a constant current value during the time r1, and causes the light source to intermittently emit light by making the light-emission duty less than 100% at the same current value as that in the r1 during the time r2.

2. A fixing device comprising a conveyance portion for conveying a recording medium; a light source for irradiating an unfixed toner image formed on the recording medium conveyed by the conveyance portion; and a light output control portion for controlling light output from the light source, that melts a toner of the toner image by light from the light source to fix the toner image to the recording medium, wherein when a conveyance speed of the recording medium is p (mm/sec), a length of a light irradiation area on the recording medium in a conveyance direction of the recording medium is q (mm), time during which the toner of the unfixed image is exposed to light while it is conveyed is r (sec) (r=q/p), and energy that is given to the toner of the unfixed image per unit area is J (J=light output per unit area (W/mm$^2$)×time r (sec)), the light output control portion controls the light output of the light source so that the energy during a constant time r1 (sec) from the start of the time r is differentiated from the energy during time r2 (sec) until the end of the time r after the elapse of the r1 (r2=r−r1), wherein the light output control portion makes a current value of the light source during the time r1 is to be I1, a current value of the light source during the time r2 is to be I2 (I1>I2), and causes continuous light emission with 100% light-emission duty during both the time r1 and the time r2.

3. The fixing device as defined in claim 1, wherein a semiconductor laser is provided as the light source.

4. The fixing device as defined in claim 3, wherein the light source has a plurality of the semiconductor lasers, and the plurality of the semiconductor lasers form a laser array arranged in an array in a direction orthogonal to a conveyance direction of a recording sheet.

5. An image forming apparatus comprising the fixing device as defined in claim 1.

6. An image forming apparatus comprising the fixing device as defined in claim 2.

7. The fixing device as defined in claim 2, wherein a semiconductor laser is provided as the light source.

8. The fixing device as defined in claim 7, wherein the light source has a plurality of the semiconductor lasers, and the plurality of the semiconductor lasers form a laser array arranged in an array in a direction orthogonal to a conveyance direction of a recording sheet.

* * * * *